US005216766A

United States Patent [19]

Lang

[11] Patent Number: 5,216,766

[45] Date of Patent: Jun. 8, 1993

[54] SHOWER CURTAIN ROD ATTACHMENT

[76] Inventor: Randall P. Lang, 1183 W. 900 North, Provo, Utah 84601

[21] Appl. No.: 860,895

[22] Filed: Mar. 31, 1992

[51] Int. Cl.[5] ..... A47K 3/14

[52] U.S. Cl. ..... 4/609; 4/610

[58] Field of Search ..... 4/558, 607, 608, 609, 4/610; 160/123, 124, 125, DIG. 6, 330, 349, 237; 16/87 R, 87.4 R, 94 R; 211/105.2

[56] References Cited

U.S. PATENT DOCUMENTS

| | | | |
|---|---|---|---|
| 1,008,685 | 11/1911 | Wildman | 160/125 |
| 1,147,944 | 7/1915 | Holdensen | 160/125 |
| 1,148,970 | 8/1915 | King | 4/558 |
| 1,204,570 | 11/1916 | Holmen et al. | 160/125 |
| 1,375,538 | 4/1921 | Scheurer et al. | 160/125 |
| 2,778,030 | 1/1957 | Gouche | 4/610 |
| 3,418,665 | 12/1968 | Long | 4/610 |

FOREIGN PATENT DOCUMENTS

| | | | |
|---|---|---|---|
| 0278627 | 10/1927 | United Kingdom | 211/105.2 |

*Primary Examiner*—Henry Recla
*Assistant Examiner*—Casey Jacyna
*Attorney, Agent, or Firm*—Craig S. Barrus

[57] ABSTRACT

This invention discloses a shower curtain rod attachment which prevents water from spraying or splashing out of a shower enclosure while showering. The shower curtain rod attachment supports the leading edge of the shower curtain such that the shower curtain is parallel to the front surface of the shower enclosure. The arm of the shower curtain rod attachment attaches to the front of the shower enclosure with a hook, a clip, a suction cup, or other suitable device when the shower is in use. After showering, the arm is detached from the shower enclosure wall and allowed to rotate downward. The shower curtain can then be slid along the curtain rod to open the shower enclosure. A slit in the tube of the shower curtain rod attachment allows the device to be installed over an existing curtain rod without the need of removing the curtain rod. No tools or special skills are needed.

8 Claims, 3 Drawing Sheets

SHOWER CURTAIN ROD ATTACHMENT

BACKGROUND

Field of Invention

This invention relates to shower curtain rods, and in particular, to attachments to the shower curtain rod to allow the edge of a shower curtain to be held against the shower enclosure walls to prevent water from splashing between the shower curtain edges and walls onto the shower floor or adjacent walls.

Shower/tub enclosures are typically provided with a thin, flexible shower curtain to prevent water from splashing out of the shower enclosure. The shower curtain is drawn across the open side to provide closure. However, a thin gap is typically left between the edge of the shower curtain and the wall, which allows water to escape. This water presents a slip and fall hazard if water accumulates on the floor which makes the floor slippery. Additionally, over a period of time, this water may damage the floor and the substructure, which could necessitate costly repairs. Minor damage may occur in shorter periods of time due to mildew or mold.

Description of Related Art

Two patents have been issued which recognize the fact that shower spray can be more effectively contained if the shower curtain is returned inward toward the shower enclosure a short distance. In 1983, a patent was issued to File (U.S. Pat. No. 4,385,409) which a hinged device is attached to the curtain, which is then placed on a hook or attachment located on the front of the shower enclosure. Half of the hinge is supported by the curtain rod, and the other half by the hook. However, the hinged device may be difficult to install, and may be difficult to operate particularly for children and elderly to use because some manual dexterity is required.

Another patent was issued to Skrzelowski (U.S. Pat. No. 4,769,862) which again turns the curtain inward along the front of the shower enclosure to prevent spray from escaping the shower enclosure. This device is a track with curved ends, and the curtain follows the track and curves inward toward the shower enclosure to provide the seal. However, this invention requires the entire track to be replaced. This necessitates a fairly degree of technical ability and the use of tools. It also appears that a special shower curtain may be needed to fit the curtain rod. Thus, to retrofit existing applications, the old curtain rod must be discarded and the new rod, and perhaps curtain, must be installed.

There is another class of patents which provide for a leak-tight seal at the vertical edge of the curtain to provide the seal. See, Zellinger (U.S. Pat. No. 4,759,087), White (U.S. Pat. No. 3,639,919), Armstrong (U.S. Pat. No. 3,879,806) and Dezura (U.S. Pat. No. 4,077,072). Most of these devices are difficult to install. Additionally, over a period of time, the closure devices may wear and tend to leak inasmuch as the seal is not as tight as when it was first installed.

SUMMARY OF THE INVENTION

With the foregoing in mind, it is a principal object of this invention to provide a shower curtain closure device which is simple to install with no tools or the like required.

Another object is to provide a device which is simple to operate, with no instructions required. This is a particularly important requirement in the motel industry, where customers need to understand the operation without a lengthy instruction manual or the like.

It is another object of this invention to provide a closure that is relatively easy to operate with one hand, and which does not require a great deal of manual dexterity. This would particularly benefit the elderly and children.

These and other objects of the present invention may be achieved through a simple two-piece device. One piece is the shower curtain rod attachment, that slips over the curtain rod and supports a short section of the shower curtain. The other piece is an attachment for securing the shower curtain rod attachment arm to the shower enclosure, such as a wall hook, which supports the arm of the shower curtain rod attachment while the shower is being used.

The present invention slips over the curtain rod without the necessity of tools. In fact, the shower curtain rod need not even be removed. Shower curtain hooks are attached to the arm and to the shower curtain. As soon as the wall hook or other means of attachment is installed on the front of the shower enclosure, the device is ready to be used. The front of the shower enclosure is that part of the shower enclosure that contains the shower head. The rear of the shower enclosure is the opposite parallel surface. No tools are required, and a minimal skill level is needed to install the device.

To use the device, the shower curtain rod attachment and the curtain to which it is attached is slid along the shower curtain rod to cover the shower enclosure opening. When the shower curtain rod attachment reaches the end of its travel, the arm of the shower curtain rod attachment is placed in the wall hook. This places the curtain along the front of the shower enclosure, and in this position, shower spray is effectively contained within the shower enclosure.

There are several means for attaching the arm of the shower curtain rod attachment to the wall. A simple hook adhesively attached to the shower enclosure is one method. Another would be to attach a suction cup to the arm of the shower curtain rod attachment, and sticking the suction cup to the wall before showering. Another method would be to provide a short dowel which would be adhesively attached to the wall of the shower enclosure, and the arm would have a hole for receiving the dowel member. Even another attachment means would be by means of a clip which would be adhesively mounted to the shower enclosure. The arm would engage the clip and be retained until the arm was removed from the clip.

To exit the enclosure, it is a simple matter to lift the arm of the shower curtain rod attachment from the hook and slide the shower curtain rod attachment, and its attached curtain, away from the front edge of the shower enclosure. The shower curtain rod attachment can then rotate freely downward as drawn by gravity. This is the storage position until the next shower.

Alternatively, it would be possible to leave the shower curtain rod attachment in the closed position and enter and exit the shower from the rear of the shower enclosure. The present invention could be left untouched throughout the present and all subsequent showers.

The shower curtain rod attachment could also be used at the rear of the shower enclosure as well as the front of the enclosure. However, because most spray is generated near the front of the shower enclosure, the device would be most effective at the front of the enclosure. However, the device would be useful in limiting the spray that leaves the shower enclosure at the rear of the shower enclosure.

BRIEF DESCRIPTION OF THE DRAWINGS

The invention will become even more readily apparent from the following detailed description of a preferred embodiment and from the drawings in which.

DETAILED DESCRIPTION OF THE PREFERRED EMBODIMENT

Figure 1:
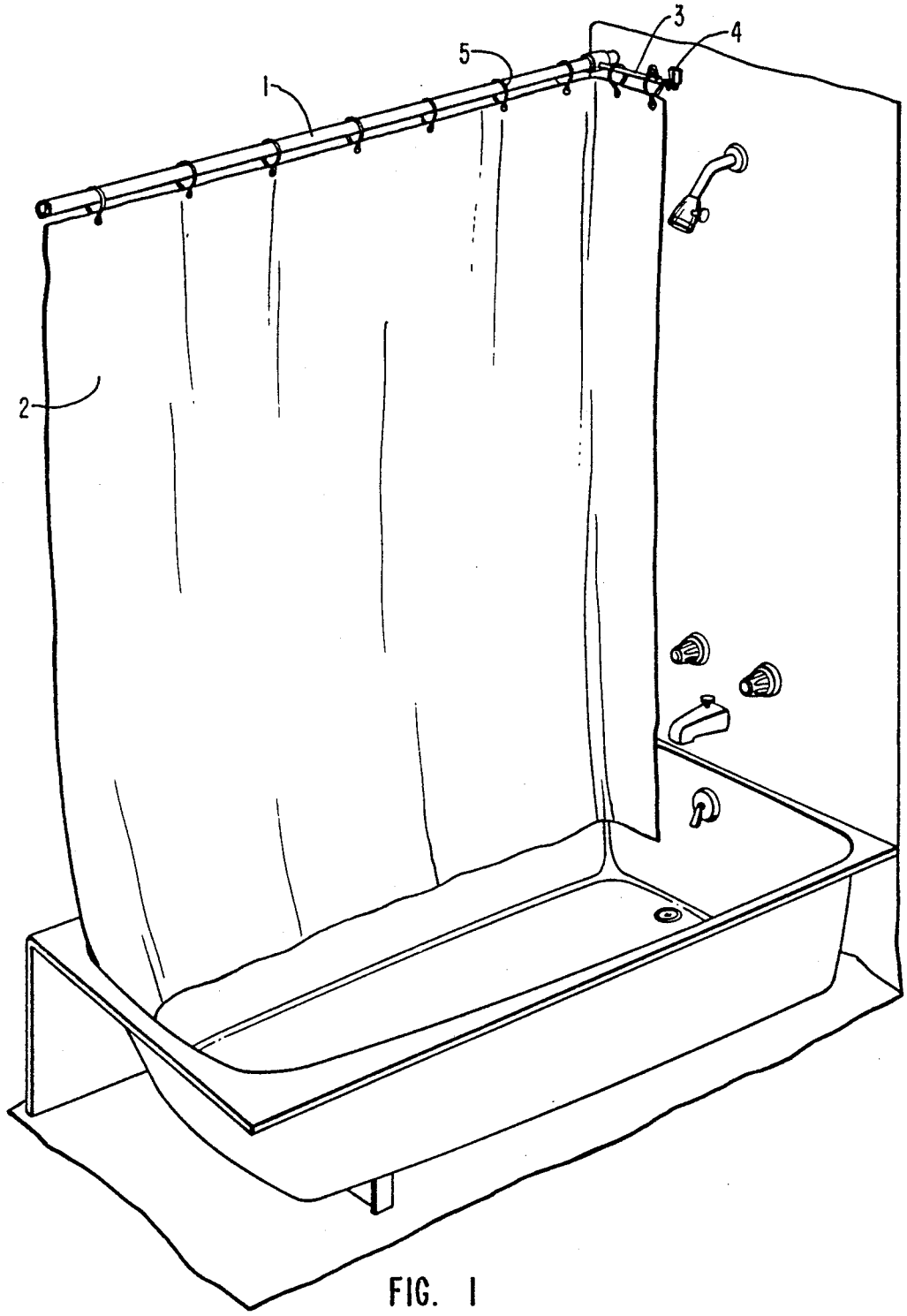
FIG. 1 is a partial perspective of the preferred embodiment of the invention mounted in a shower enclosure and having a shower curtain mounted thereon.

Referring now in detail to the drawings, and initially to FIG. 1, there is shown a preferred form of a shower curtain rod attachment 3 in accordance with this invention which is of a simple two-piece construction, including a wall hook 4 which is attached to the vertical wall surface at the front of the shower enclosure. The shower curtain rod attachment 3 is mounted slidably and rotatably over the curtain rod 1, which supports the shower curtain 2 by shower curtain hooks 5. The leading edge of the shower curtain 2 is supported by the shower curtain rod attachment 3 in such a manner that the shower curtain 2 is in a plane parallel to the vertical wall surface at the front of the shower enclosure to prevent spraying or splashing outside of the shower enclosure.

Figure 2:
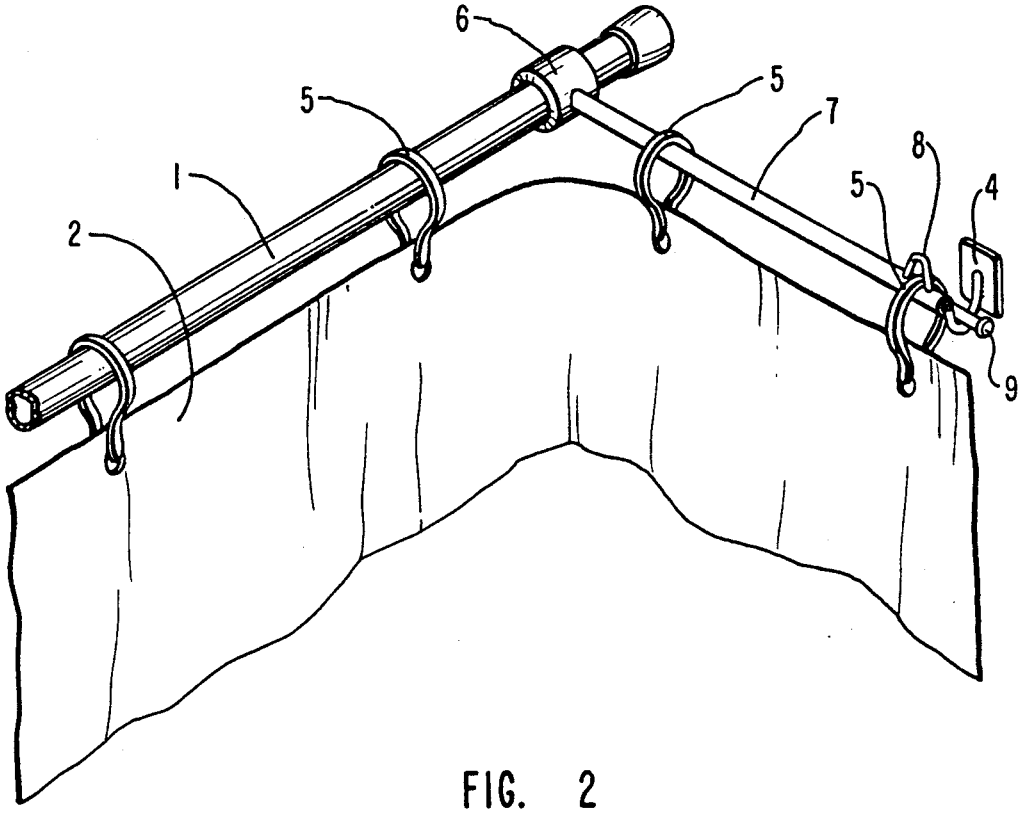
FIG. 2 is a partial perspective of the preferred embodiment showing the details of the present invention.

As best seen in FIG. 2, which is a perspective of the shower curtain rod attachment 3, the various parts of the shower curtain rod attachment 3 are shown. The shower curtain rod attachment 3 is slidably and rotatably mounted on the curtain rod 5. The tube 6 which slides and rotates around the curtain rod 5 has an arm 7 which is mounted perpendicularly to the longitudinal axis of the tube 6. A handle 9 is formed at the end of the arm 7 to be easily grasped by the hand. The curtain 2 is attached to the arm 7 by not less than one curtain hook 5. In the preferred embodiment shown in FIG. 2, the leading edge of the curtain 2 is attached to the arm 7 by a curtain hook 5 which passes through a bail 8. Bail 8 prevents the curtain 2 from slipping off the arm 7 when the shower curtain rod attachment 3 is removed from the wall hook 4. When the shower curtain rod attachment 3 is removed from the wall hook 4, the arm 7 rotates downward by gravity to a nearly vertical position. The shower curtain rod attachment 3, to which is attached the leading edge of the curtain 2, can then be slid rearward along the curtain rod 1 to open the shower enclosure to allow a person to exit the shower enclosure.

Figure 3:
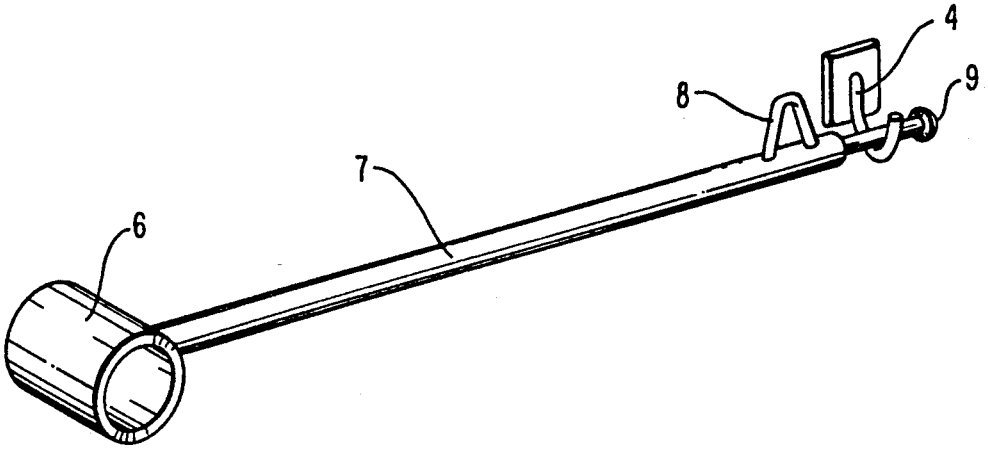
FIG. 3 is a partial perspective of the preferred embodiment.

FIG. 3 shows the shower curtain rod attachment 3 showing only the preferred embodiment without the shower curtain 2. Arm 7 is attached perpendicularly to tube 6. Bail 8 is located at one end of arm 7. Arm 7 has a handle 9 which is received by a wall hook 4 which is mounted to the front wall of the shower enclosure. The tube 6 in this figure is shown without the slit 10 shown in FIGS. 4 and 5. This type of tube 6 would be applicable to those installations where the curtain rod 1 could easily be removed, and the curtain rod attachment 3, without the slit, could be slid over the end of the curtain rod 1. The curtain rod 1 could be reinstalled, and in this configuration, the shower curtain rod attachment 3 would be perhaps a little more secure than perhaps the tube 6 with a slit 10 described in FIG. 3.

Figure 4:
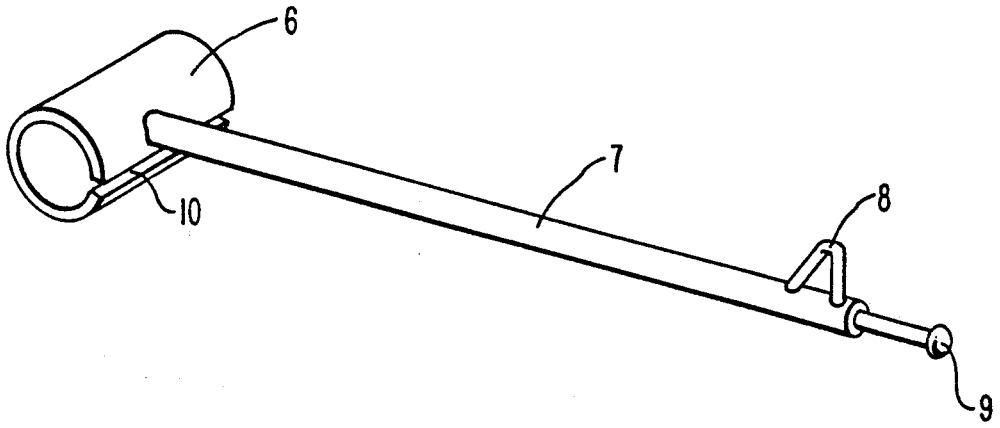
FIG. 4 is a top perspective showing an alternate configuration of the tube.

FIG. 4 shows a configuration wherein tube 6 has a slit 10 in which is parallel to the longitudinal axis of the tube 6. The slit 10 is sized such that the tube 6 can be forced over the curtain rod 1 by deforming elastically without the necessity of removing the curtain rod 1. In other words, the slit 10 can be forced open a distance slightly greater than the diameter of the curtain rod 1 to allow the tube 6 to pass over and engage the curtain rod 1. The tube 6 is desirably made of a plastic material which imparts the desired rigidity and flexibility which this device requires. The slit 10 is located in the tube 6 such that when the arm 7 is at a three o'clock position, or horizontal, the slit will be somewhere around the four o'clock or five o'clock position. When the arm 7 is removed from the wall hook 4 and allowed to rotate downward to the six o'clock position, or vertical, the slit will be somewhere around the seven o'clock or eight o'clock position. This prevents gravity or the weight of the curtain 2 from disengaging the tube 6 from the curtain rod 1.

Figure 5:
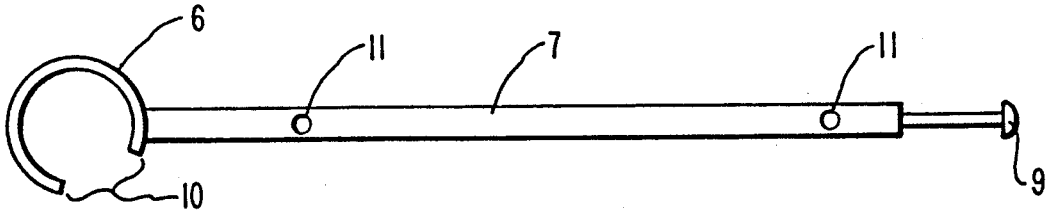
FIG. 5 is a side perspective of the present invention showing an alternate method of attaching the shower curtain hooks to the shower curtain rod attachment.

FIG. 5 shows an alternative arrangement of the arm 7. In this embodiment, the arm 7 has at least one hole 11 for receiving a curtain hook 5.

From the foregoing, it will now be apparent that the closure device as shown in the present invention provides a relatively simple and effective means for keeping one or both edges of the shower curtain up against the front and rear walls of the shower enclosure so that the adjacent wall and floor surfaces outside of the shower enclosure remain dry, safe, and mildew free. The shower curtain rod attachment is installed easily and quickly without the need of any tools or special skills, and even without the necessity of removing the shower curtain rod.

The present invention, of course, may be carried out in other specific ways than those set above without departing from the scope of this invention. The above embodiments are, therefore, to be considered as illustrative, and applicant intends only to be limited by the claims appended hereto.

I claim:

1. A shower curtain rod attachment for supporting a shower curtain by curtain hooks from a curtain rod in a shower enclosure, said shower enclosure having rear and side walls defining an open front, said rod having opposite ends attached to respective side walls such that said rod extends horizontally thereacross, comprising:

a) a tube adapted to be slidably and rotatably mounted on said curtain rod;

b) an arm attached perpendicularly to said tube and adapted to be attached to an end portion of the shower curtain whereby said arm would support the end portion of the shower curtain parallel to the plane formed by a side wall of the shower enclosure when the remaining portion extends across the open front of the shower enclosure; and c) means for removably attaching said arm to one of the sidewalls of the shower enclosure to maintain said arm in a substantially horizontal position.

2. A shower curtain rod attachment as described in claim 1, wherein said tube further has a slit parallel to the longitudinal axis of said tube for installing said tube slidably and rotatably around the shower curtain rod without the necessity of removing the shower curtain rod.

3. A shower curtain rod attachment as described in claim 2, wherein said arm further has one or more bails for receiving a shower curtain hook.

4. A shower curtain rod attachment as described in claim 2, wherein said arm has one or more holes for receiving a shower curtain hook.

5. A shower curtain rod attachment as described in claim 4, wherein said arm has a handle for removing and replacing said arm within said means for removably attaching said arm to the shower enclosure, said handle located on said arm at the opposite end of said tube.

6. A shower curtain rod attachment as described in claim 3, wherein said arm has a handle for receiving and replacing said arm within said means for removably attaching said arm to the shower enclosure, said handle located on said arm at the opposite end of said tube.

7. A shower curtain rod attachment as described in claim 2, wherein said slit is located between a four o'clock position and a six o'clock position when said arm is horizontal at the three o'clock position.

8. A shower curtain rod attachment as described in claim 1, wherein said means for removably attaching said arm to the shower enclosure is a wall hook.

* * * * *